US007731035B2

(12) United States Patent
Zubovich et al.

(10) Patent No.: US 7,731,035 B2
(45) Date of Patent: Jun. 8, 2010

(54) ORE SCREENING PANEL FRAME SYSTEM

(75) Inventors: Jeff Zubovich, Sunshine (AU); Gordon Ashley, Ryde (AU)

(73) Assignees: Screenex Australia Pty Ltd, Sunshine (AU); Schenck Australia Pty Ltd, Ryde (AU)

( * ) Notice: Subject to any disclaimer, the term of this patent is extended or adjusted under 35 U.S.C. 154(b) by 456 days.

(21) Appl. No.: 11/346,407

(22) Filed: Feb. 3, 2006

(65) Prior Publication Data

US 2006/0175233 A1 Aug. 10, 2006

(30) Foreign Application Priority Data

Feb. 7, 2005 (AU) ..... 2005900524

(51) Int. Cl.
*B07B 1/49* (2006.01)

(52) U.S. Cl. ..... 209/405; 209/399

(58) Field of Classification Search ..... 209/393, 209/399, 403, 404, 405
See application file for complete search history.

(56) References Cited

U.S. PATENT DOCUMENTS

| | | | | |
|---|---|---|---|---|
| 4,137,157 | A * | 1/1979 | Deister et al. | 209/403 |
| 4,141,821 | A | 2/1979 | Wolff et al. | |
| 5,372,261 | A * | 12/1994 | Galton et al. | 209/399 |
| 5,377,846 | A * | 1/1995 | Askew | 209/405 |
| 5,755,334 | A * | 5/1998 | Wojcik et al. | 209/399 |
| 5,829,599 | A * | 11/1998 | Woodgate | 209/399 |
| 6,253,926 | B1 * | 7/2001 | Woodgate | 209/399 |
| 6,543,621 | B2 * | 4/2003 | Baltzer et al. | 209/405 |
| 2002/0195377 | A1 | 12/2002 | Trench et al. | |
| 2006/0163121 | A1 * | 7/2006 | Fisher et al. | 209/399 |

FOREIGN PATENT DOCUMENTS

| | | |
|---|---|---|
| AU | 482212 | 2/1976 |

(Continued)

OTHER PUBLICATIONS

European Search Report in EP Appl. 06075250.8 dated Sep. 6, 2006.

*Primary Examiner*—Patrick Mackey
*Assistant Examiner*—Kalyanavenkateshware Kumar
(74) *Attorney, Agent, or Firm*—Connolly Bove Lodge & Hutz LLP

(57) ABSTRACT

An ore screening deck frame system which consists of a machine frame having a machine attachment portion and a support rail attachment portion and a panel support rail having a frame attachment portion and a panel attachment portion where in the rail attachment portion of the frame and the frame attachment portion of the rail are in end view cross section of a complementary shape so that the frame and rail can be locked together. The frame member comprises a vertically disposed web adapted to be secured to the screening machine and a frame support extending laterally of the upper edge of said web wherein the web and support are formed from reinforced wear resistant elastomeric material and the support consists of a central channel section in which the width of the channel opening is narrower than the internal width of the channel and the external lateral edges of the frame support include protrusions adapted to retain screen panel support rails. The frame is preferably made from polyurethane moulded over an inverted L section steel frame member.

3 Claims, 5 Drawing Sheets

FOREIGN PATENT DOCUMENTS

| | | |
|---|---|---|
| AU | 7266374 | 2/1976 |
| AU | 517319 | 2/1979 |
| AU | 556953 | 3/1983 |
| AU | 559443 | 6/1984 |
| AU | 662683 | 5/1995 |
| AU | 700843 | 5/1996 |
| AU | 699604 | 2/1997 |
| AU | 711096 | 1/1998 |
| AU | 742060 | 6/1999 |
| AU | 755595 | 8/2000 |
| AU | 2002300432 | 6/2003 |
| DE | 3732031 | 1/1989 |
| DE | 19860612 | 7/2000 |

* cited by examiner

ORE SCREENING PANEL FRAME SYSTEM

This invention relates to frames for use in vibratory screening machines of the type used in mining and quarrying.

BACKGROUND TO THE INVENTION

Australian patent 482212 proposed a modular screening panel system for ore screening decks which is now widely used by the mining industry and replaced the earlier screening cloths, and large wire screening frames. The screening panels were all of the same size [eg. 300 mm] and made of reinforced polyurethane. The panels are adapted to be secured to an underlying support frame using dependent spigots which are a force fit into corresponding apertures in the support frame. The underlying support frame was designed specifically for the panels and itself was secured to the machine frame fitted as original equipment by the screening machine manufacturer.

A variety of methods have evolved for securing modular panels to the screening machines which use pin expanded spigots or edge flanges and all require complementary support frames which need to be assembled to the machine frame. Typical embodiments of these various systems are disclosed in patents 517319, 556953, 559443, 700843, 711096, 742060 and 755595.The machine frame supplied as original equipment for the screening machines to which the support frames for the screening panels is fitted is usually an inverted L section in which the upper horizontal flange has bolt holes along its length so that the support frames can be secured. Thus in installing a screening deck the support frames must first be assembled and bolted in place before the panels can be fitted.

The machine frame is subjected to erosion and corrosion by the fines and other corrosive liquids passing over the frames during the screening operation. Patent 699604 proposed a deflector plate of polyurethane be secured between the support frame and the machine frame to address this problem.

It is an object of this invention to improve the speed of assembly of screening decks and also increase the wear life of the machine frames.

BRIEF DESCRIPTION OF THE INVENTION

To this end the present invention provides an ore screening deck frame system which consists of a machine frame having a machine attachment portion and a support rail attachment portion and a panel support rail having a frame attachment portion and a panel attachment portion where in the rail attachment portion of the frame and the frame attachment portion of the rail are in end view cross section of a complementary shape so that the frame and rail can be locked together.

In another aspect the present invention provides a frame member for an ore screening machine comprising a vertically disposed web adapted to be secured to the screening machine and a frame support extending laterally of the upper edge of said web wherein the web and support are formed from reinforced wear resistant elastomeric material and the support consists of a central channel section in which the width of the channel opening is narrower than the internal width of the channel and the external lateral edges of the frame support include protrusions adapted to retain screen panel support rails.

The frame is adapted to retain a support rail that incorporates an underneath channel section with an end cross section adapted to enclose the frame support and including a protruding rib within the channel adapted to slide within the channel section of the frame support. The support rail may on its upper surface be adapted to secure screening panels by any of the known securing arrangements. The frame is preferably made from polyurethane or rubber moulded over an inverted L section steel frame member. The support rail is also made from polyurethane or rubber.

The advantage of this arrangement is that the support frame for a screening system can be assembled quickly on the machine frame without any need to bolt the support frame to the machine frame. In addition because the support rail is polyurethane or rubber which is the same material commonly used to form the modular screening panels the useful life of the machine frame is extended.

DETAILED DESCRIPTION OF THE INVENTION

A preferred embodiment of the invention will be described with reference to the drawings in which.

Figure 2B:
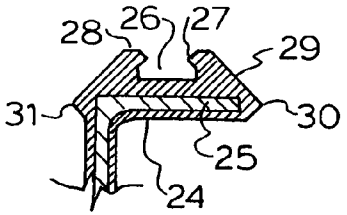
FIG. 2A is a plan view and FIGS. 2B and C are end views of the frame member of FIG. 1.
Figure 2C:
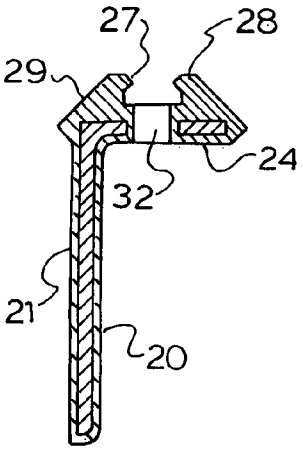
Figure 1:
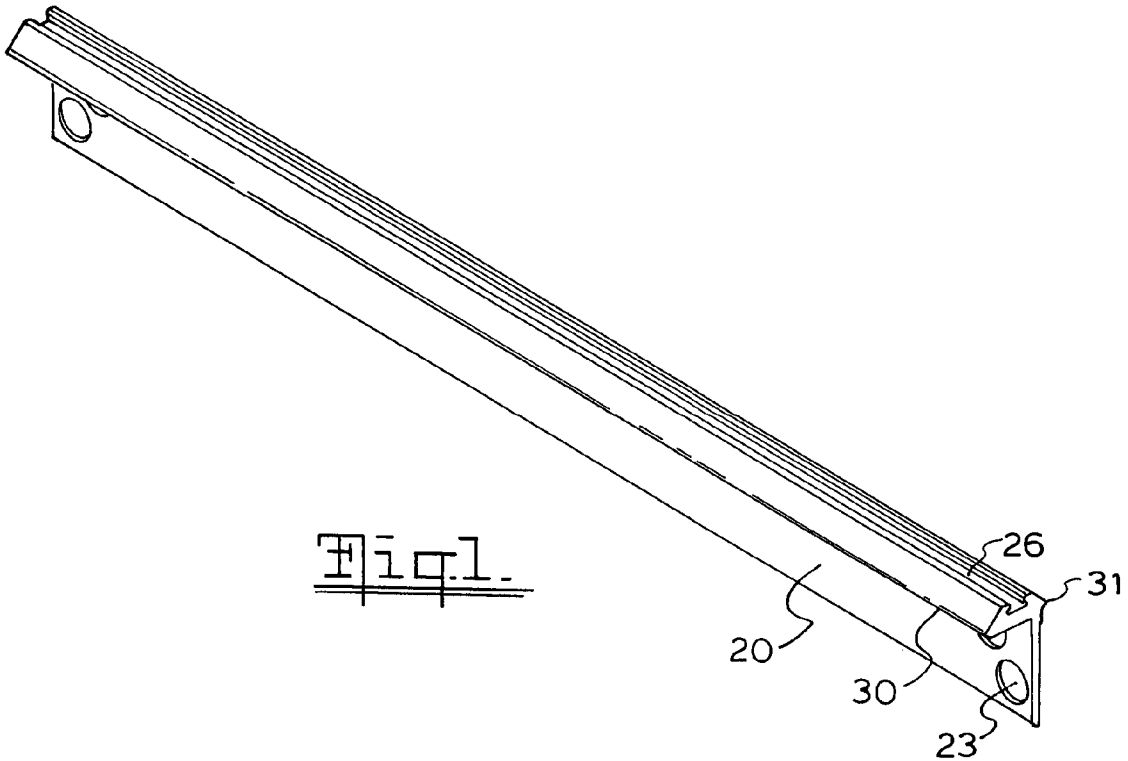
FIG. 1 is a perspective view of a machine fame member according to this invention.
Figure 2A:
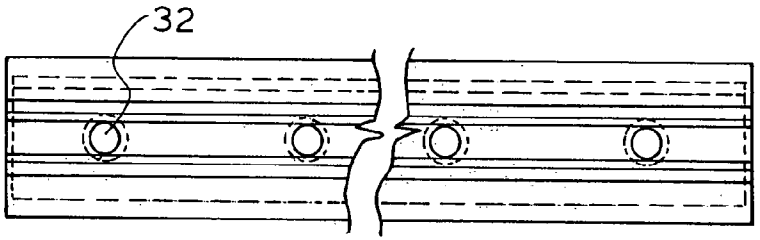

FIGS. 1 and 2 illustrate the machine frame member of this invention. The frame member is injection moulded over an inverted L steel reinforcing member with a vertical web 21 inside the vertical web 20 of the frame and the lateral rail support 24 is reinforced by the lateral flange 25 of the inverted L reinforcement. The web 20 incorporates bolt holes 23 to enable the machine frame to be secured to the screening machine.

The rail support portion 24 of the machine frame member includes a longitudinal channel 26 defined by the shoulders 28. the opening of the channel 26 is narrowed by the edge ribs 27 so that the width of the channel is wider than the opening. The external surfaces 29 of the shoulders 28 incline downwardly and outwardly to end in the protuberances 30 and 31 at the lateral extremities of the rail support portion 24. The rail support 24 is preferably made fro hard wearing polyurethane or rubber of grades similar to that used in moulding screening panels. Bolt holes 32 are provided for securing the panel support rails to the rail support 24.

Figure 4A:
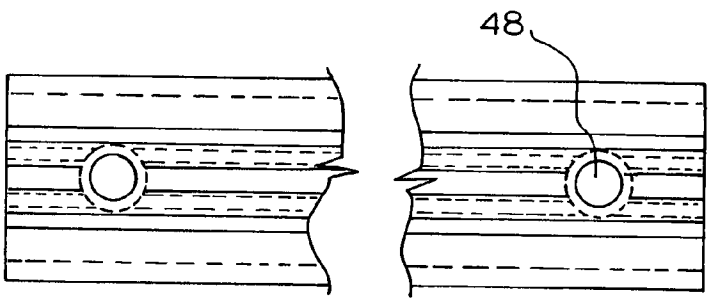
FIG. 4A is a plan view and 4B is an end view of the rail of FIG. 3.
Figure 4B:
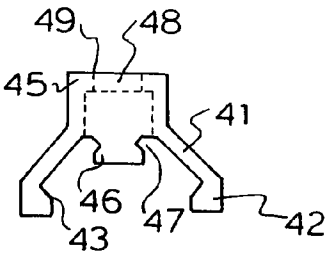
Figure 3:
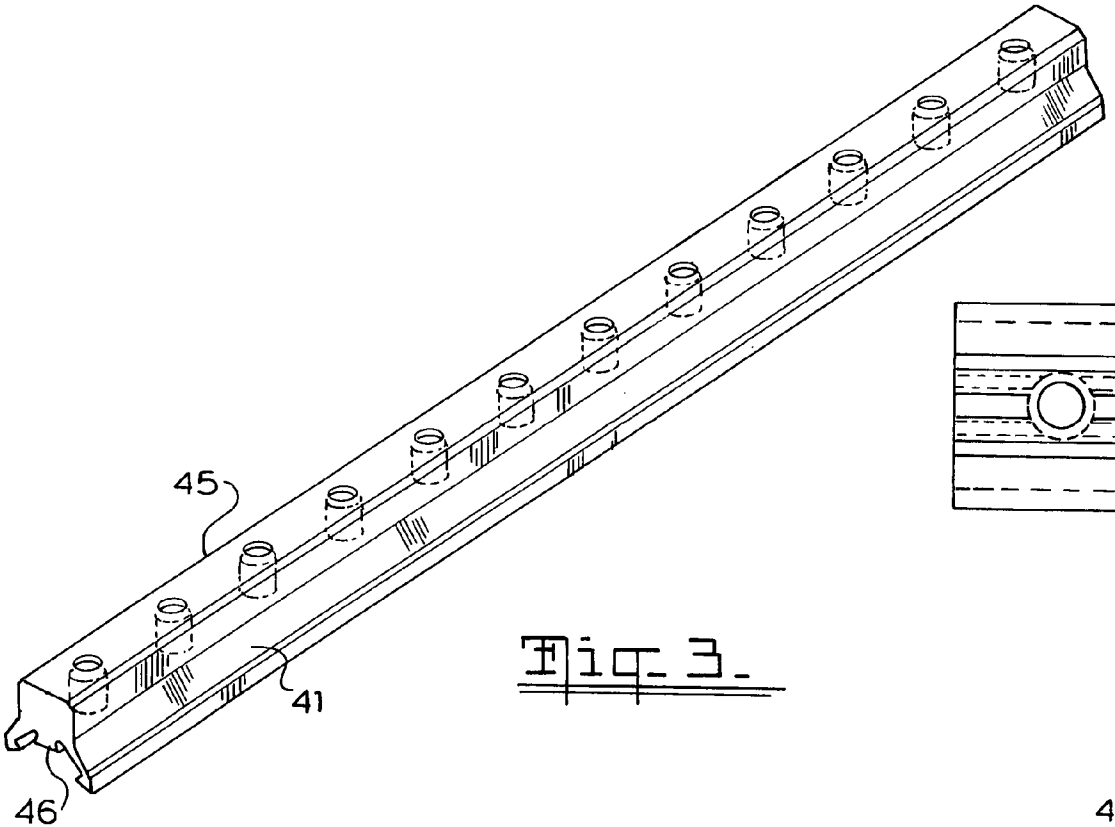
FIG. 3 is a perspective view of a first embodiment of a support rail of this invention for fitting to the frame member of FIGS. 1 and 2.

FIGS. 3 and 4 illustrate a screen support rail adapted to secure screening panels with headed spigots of the kind described in patents 482212, 517319, 662683 and 711096.The rail support comprises attachment legs 41 with feet 42 having inwardly directed ribs 43 adapted and shaped to fit over the shoulders 28 and around the protuberances 30 and 31 of the support portion 24 of the machine frame member. The headed protuberance 46 is shaped to fit within the recess 26 of the support portion 24 of the machine frame member. The recess 47 is shaped to accommodate the edge ribs 27 of the support portion 24 of the machine frame member. The body portion 45 of the support rail incorporates a recess 48 to accommodate the spigots of the screening panels. The spigots are forced past the edge rim 49 of the recess 48 so that the screening panels are securely held in place.

Figure 6A:
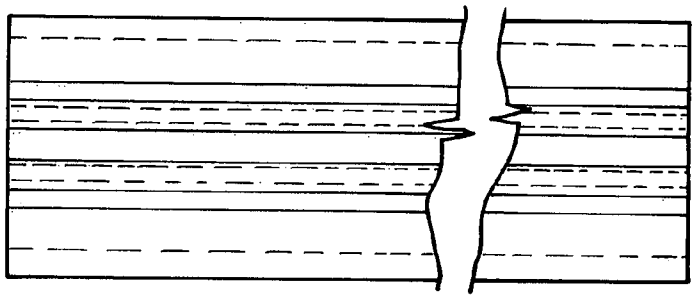
FIG. 6A is a plan view and FIGS. 6B and 6C are end views of the rail of FIG. 5.
Figure 6B:
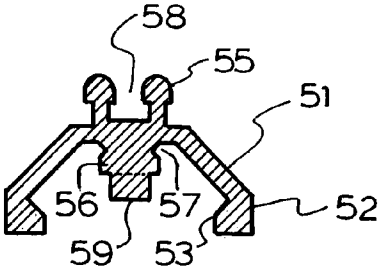
Figure 6C:
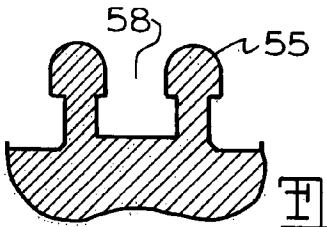
Figure 5:
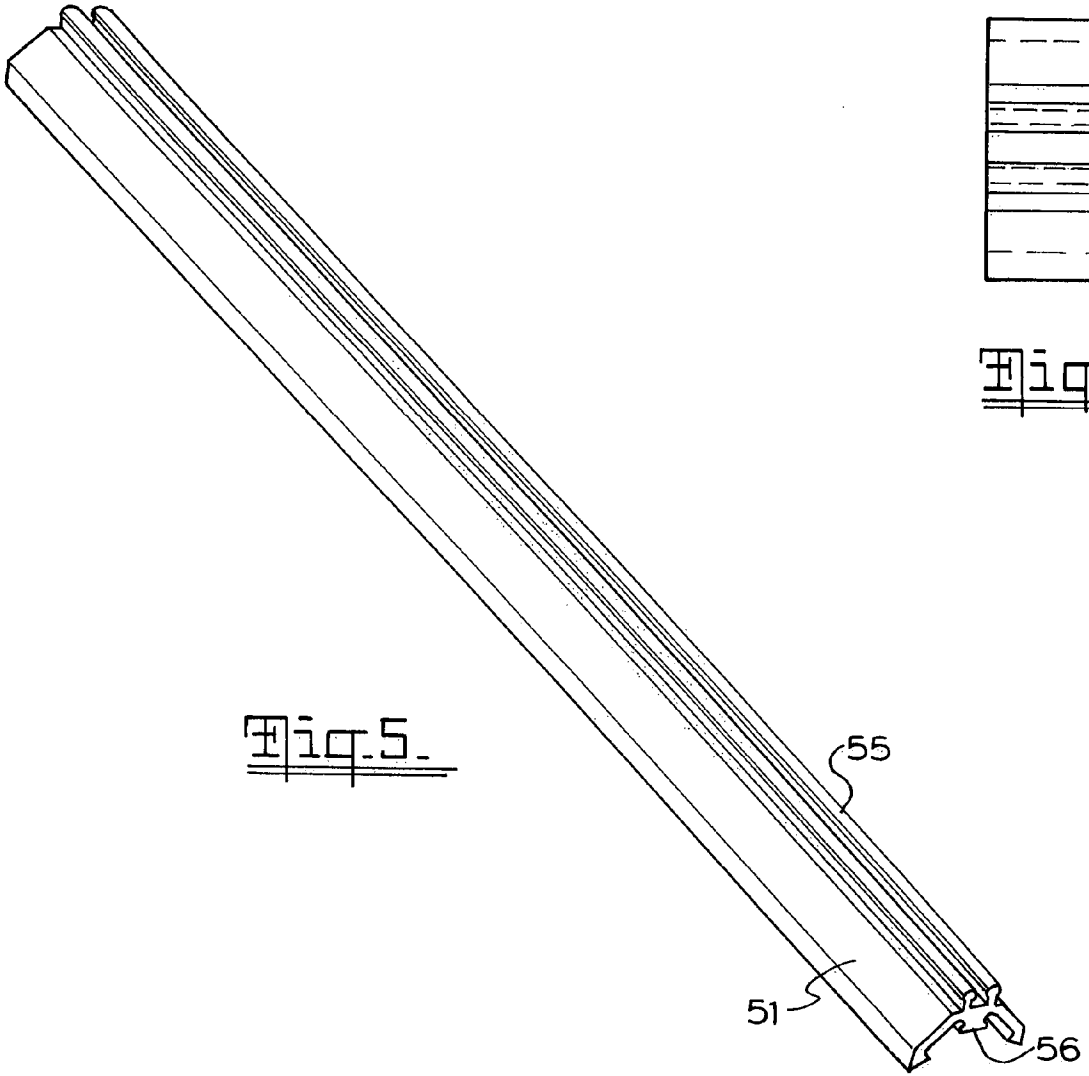
FIG. 5 is a perspective view of a second embodiment of a support rail of this invention for fitting to the frame member of FIGS. 1 and 2.

FIGS. 5 and 6 illustrate a screen support rail adapted to secure screening panels with longitudinal edge flanges of the kind described in patents 559443 and 755595. The rail support comprises attachment legs 51 with feet 52 having inwardly directed ribs 53 adapted and shaped to fit over the shoulders 28 and around the protuberances 30 and 31 of the support portion 24 of the machine frame member. The headed protuberance 56 is shaped to fit within the recess 26 of the support portion 24 of the machine frame member. The recess 57 is shaped to accommodate the edge ribs 27 of the support portion 24 of the machine frame member. The boss 59 is adapted to fit into the hole 32 of the support portion 24. The headed ribs 55 define a recess 58 adapted to accommodate the edge flanges of the screening panels.

Figure 8A:
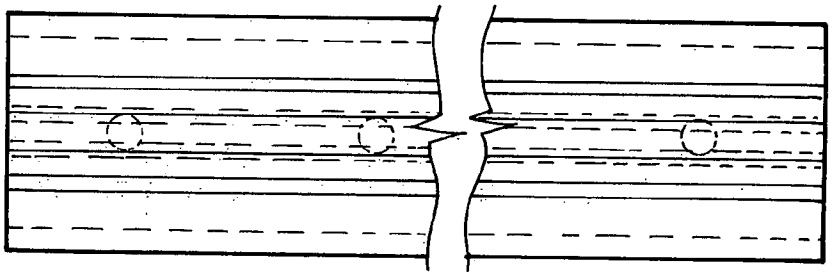
FIG. 8A is a plan view and 8B is an end view of the rail of FIG. 7.
Figure 8B:
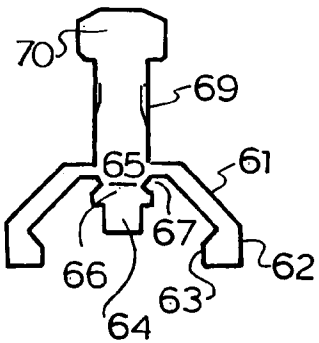
Figure 7:
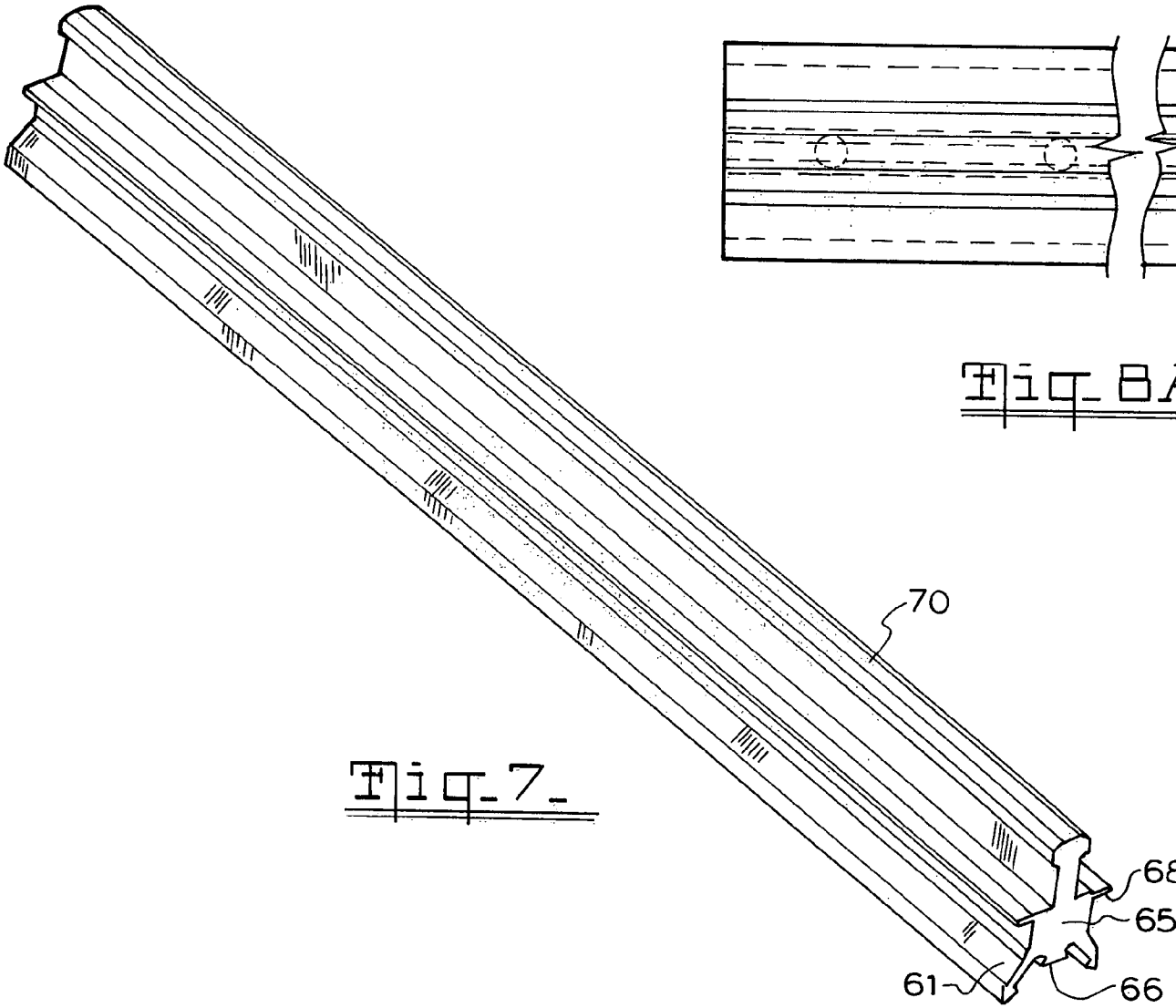
FIG. 7 is a perspective view of a third embodiment of a support rail of this invention for fitting to the frame member of FIGS. 1 and 2.
Figure 10A:
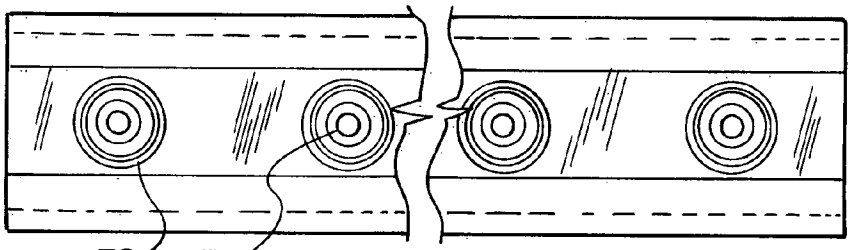
FIG. 10A is a plan view and FIGS. 10B 10C and 10D are end views of the rail of FIG. 9.
Figure 10B:
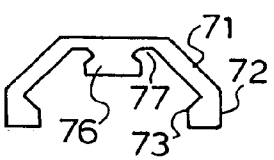
Figure 10C:
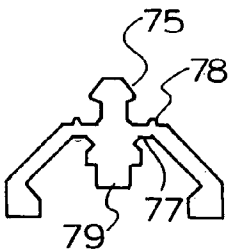
Figure 10D:
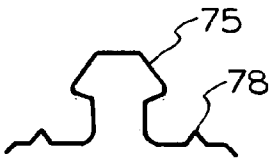
Figure 9:
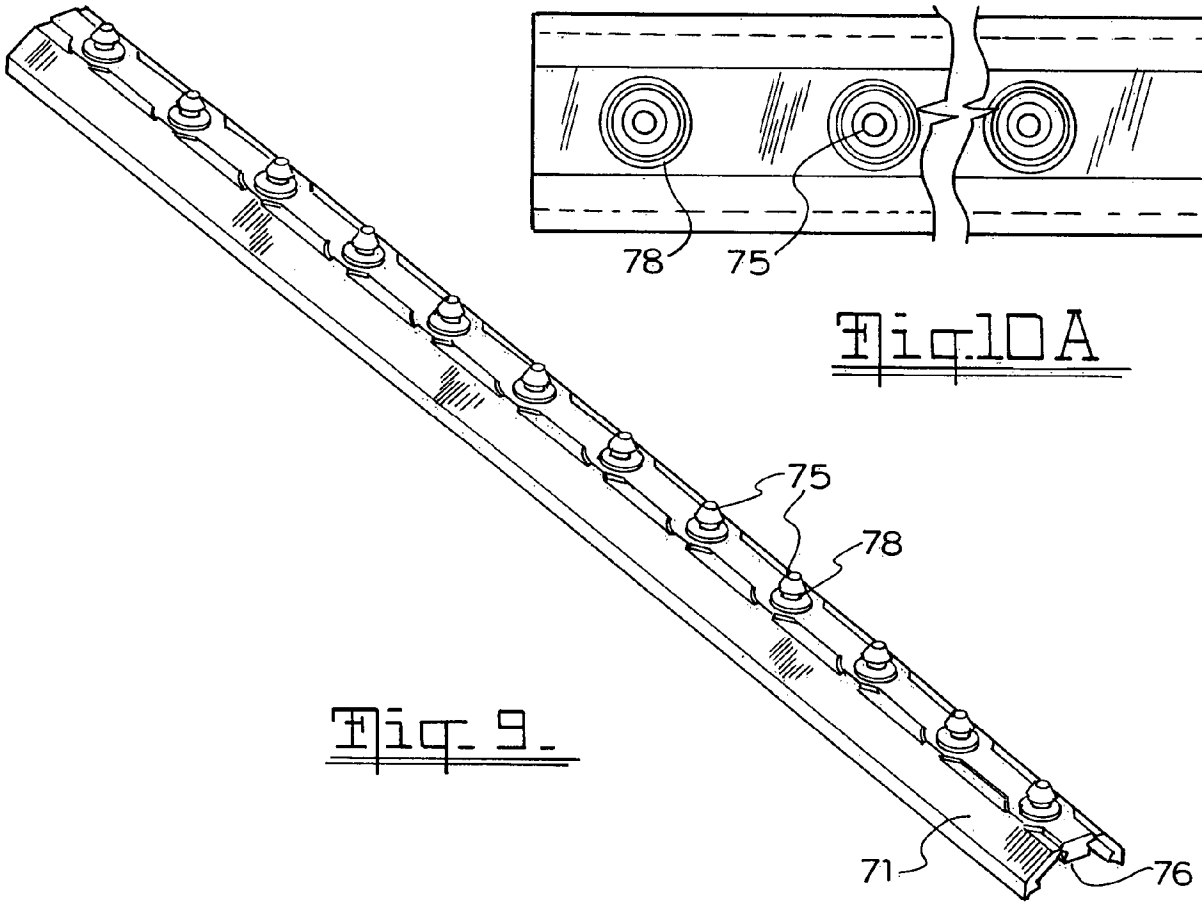
FIG. 9 is a perspective view of a fourth embodiment of a support rail of this invention for fitting to the frame member of FIGS. 1 and 2.

FIGS. 7 and 8 illustrate a screen support rail adapted to secure the edges of screening panels which have no attachment spigots or flanges. The rail support comprises attachment legs 61 with feet 62 having inwardly directed ribs 63 adapted and shaped to fit over the shoulders 28 and around the protuberances 30 and 31 of the support portion 24 of the machine frame member. The headed protuberance 66 is shaped to fit within the recess 26 of the support portion 24 of the machine frame member. The recess 67 is shaped to accommodate the edge ribs 27 of the support portion 24 of the machine frame member. The boss 64 is adapted to fit into the hole 32 of the support portion 24. The body portion 45 supports a lower support surface 68 on either side of the headed spigot 70. The edge of a panel is held in the recesses 69 on either side of the headed spigot 70. FIGS. 9 and 10 illustrate a screen support rail adapted to secure screening panels with recesses for headed spigots of the kind described in patent 2002300432.The rail support comprises attachment legs 71 with feet 72 having inwardly directed ribs 73 adapted and shaped to fit over the shoulders 28 and around the protuberances 30 and 31 of the support portion 24 of the machine frame member. The headed protuberance 76 is shaped to fit within the recess 26 of the support portion 24 of the machine frame member. The recess 77 is shaped to accommodate the edge ribs 27 of the support portion 24 of the machine frame member. The boss 79 is adapted to fit into the hole 32 of the support portion 24. The headed spigots 75 encircled by the ribs 78 protrude upwardly from the upper surface of the rail.

From the above it can be seen that this invention provides a machine frame that can easily accommodate a wide range of panel attachments systems without the need for time consuming rail assembly as no bolting is required and no special tools are required.

Those skilled in the art will realize that this invention has been described with reference to one particular embodiment but may be implemented with other shapes for the rail support portion of the machine frame. The main requirement is that the shape is complementary to the holding portion of the rails and provides a secure anchor for the rails.

The invention claimed is:

1. An ore screening deck frame system for a screening machine including a machine frame member and an interlocking screen support rail;

the frame member comprising:

a) a vertically disposed web adapted to be secured to the screening machine and extending to an integrally formed and perpendicularly extending lateral flange;

b) a lateral rail support portion fixedly mounted to the lateral flange of the frame member and having a support rail channel formed longitudinally therealong;

c) the web and rail support portion being formed from reinforced wear resistant elastomeric material; and the screen support rail comprising:

d) a body formed from reinforced wear resistant elastomeric material;

e) a frame member attachment portion with an integrally formed downwardly facing rib to mate with the entire channel in the lateral rail support portion of the frame member, the mating channel and rib having correspondingly interlocking surfaces;

f) the screen support rail further having an upwardly facing integrally formed portion for securing a separate screening panel thereto; and g) the frame member attachment portion of the rail screen support entirely embracing the lateral rail support portion of the frame member and the outer longitudinal edges of the frame member attachment portion clipping onto the outer longitudinal edges of the rail support portion.

2. The frame member of claim 1 wherein the rail support portion thereof includes protrusions adapted to retain the screen support rails.

3. The screen support rail of claim 1 wherein the frame member attachment portion thereof includes protruding ribs slidingly inserted within the channel formed within the rail support portion of the frame member.

* * * * *